United States Patent [19]

Virk et al.

[11] 4,372,111

[45] Feb. 8, 1983

[54] METHOD FOR CYCLIC REJUVENATION OF AN EXHAUST GAS FILTER AND APPARATUS

[75] Inventors: Kashmir S. Virk, Hopewell Junction; Martin Alperstein, Fishkill, both of N.Y.

[73] Assignee: Texaco Inc., White Plains, N.Y.

[21] Appl. No.: 126,815

[22] Filed: Mar. 3, 1980

[51] Int. Cl.[3] ..... F01N 3/18; F01N 3/36

[52] U.S. Cl. ..... 60/274; 55/DIG. 30; 60/297; 60/303; 60/311; 422/169; 422/178; 422/182; 422/183

[58] Field of Search ..... 60/274, 286, 297, 299, 60/303, 311; 55/466, DIG.10, DIG. 30, 419; 422/178, 169, 182, 183

[56] References Cited

U.S. PATENT DOCUMENTS

| | | | |
|---|---|---|---|
| 2,898,202 | 8/1959 | Houdry | 60/300 |
| 2,946,651 | 7/1960 | Houdry | 60/274 |
| 3,273,971 | 9/1966 | Baddorf | 60/286 |
| 3,306,035 | 2/1967 | Morrell | 60/297 |
| 3,503,716 | 3/1970 | Berger | 60/286 |
| 3,657,892 | 4/1972 | Perga | 60/288 |
| 4,054,418 | 10/1977 | Miller | 60/297 |
| 4,270,936 | 6/1981 | Mann | 60/311 |

*Primary Examiner*—Douglas Hart

*Attorney, Agent, or Firm*—Carl G. Ries; Robert A. Kulason; Robert B. Burns

[57] ABSTRACT

A system for filtering combustible particulate matter from an exhaust gas stream, and for periodically rejuvenating the filter by thermally incinerating retained particles prior to their reaching the main filter. At least a part of the exhaust gas stream which enters the filter bed is periodically heated in a pretreating chamber. The latter comprises a catalyst coated oxidizing bed into which fuel, and heated air are metered to initiate combustion. The products of said combustion are thereafter combined with the exhaust gas to bring it to a sufficient temperature to incinerate the carried particles.

8 Claims, 2 Drawing Figures

METHOD FOR CYCLIC REJUVENATION OF AN EXHAUST GAS FILTER AND APPARATUS

BACKGROUND OF THE INVENTION

With any internal combustion engine it is desirable to treat the exhaust gases so that they can be safely discharged into the atmosphere. In some engines, particularly the diesel type, among the most prevalent operating problems is the presence of particulates which are carried in the exhaust gas stream.

Primarily, the particulates are normally bits of carbon. They result from the incomplete combustion of the hydrocarbon fluid under certain engine operating conditions. However, the operating efficiency of the engine is also a contributing factor to the amount of carbon produced.

The presence of relatively large amounts of carbon particles in any exhaust gas stream may be evidenced by a dark, smoky, undesirable effluent. Such smoke is not only offensive aesthetically; in large quantities it can be unhealthy.

Means have been provided and are known to the prior art for elimination or minimization of the particulate content in exhaust discharge streams. However, it has been found that while the particulates can be minimized by a suitable filter of proper construction, eventually it can become saturated and/or inoperable due to excessive particulate accumulations.

It is further known that the overall engine exhaust gas treating process can be expedited. This is achieved not only by passing the gas stream through a filter medium, but by providing the filter with a catalyst which will promote oxidation of certain constituents present in the exhaust gas stream.

It should be appreciated that the generation of carbon particles is prevalent under all diesel engine operating conditions. It is further appreciated that the quantity and quality of an exhaust gas stream created in any internal combustion engine will vary in accordance with the operating characteristics of the engine.

For example, the temperature range experienced by the diesel exhaust gas stream can vary between slightly above ambient air temperature, and temperatures in excess of 1200° F. When the exhaust gas is hot enough, the carbon particles trapped in a filter will be combusted. However, the engine operating conditions where this rejuvenation can occur is seldom reached in diesel passenger cars.

Where it is found that an engine continuously operates under such circumstances that the particulates are continuously produced and accumulated in the filter, the particulate trapping filter bed must be occasionally rejuvenated.

Under usual circumstances, rejuvenation will consist of merely introducing the hot exhaust gas stream, containing sufficient oxygen, into the filter bed to contact and ignite or incinerate the refined carbon particles. The combustion of any large and contained carbon accumulation can, however, produce temperatures greatly in excess of that of the exhaust gas. The result is that at such excessive temperatures, the filter bed or element is susceptible to thermal shock, damage or distortion.

Toward achieving a satisfactory or limited rate of carbon removal from an exhaust gas system without incurring resulting damage to the filter, the unit presently disclosed is provided.

The instant apparatus thus comprises in brief, a pretreating chamber which contains a catalyst bed through which at least a portion of the exhaust gas stream is passed. This catalyst bed is disposed at a point upstream of, and spaced from the main filter bed.

To assure that the main or primary filter bed or beds always remain functional, the exhaust gas stream is periodically and regularly heated. It is thus brought to a temperature in excess of the temperature required to initiate combustion of retained particles. This step will preclude the build-up of any appreciable amount of combustibles.

The main filter bed, or beds when a plurality of the latter are used, will thus be regularly and at periodic intervals, rejuvenated. Such treatment, if repeated at predetermined intervals, will preclude any carbon accumulation which might otherwise lead to thermal stress or damage to the bed.

It is therefore an object of the invention to provide a filter system of the type disclosed which is capable of containing combustible particles from an exhaust gas stream, and subsequently being periodically rejuvenated by burning said particles.

A further object is to provide a particular filter of the type disclosed which is capable of removing solid elements from an exhaust gas stream while permitting periodic rejuvenation of the filter element while the engine is operating at conditions that would normally result in a relatively cool exhaust gas temperature.

A still further object is to provide an exhaust gas treating system which is capable of removing particulates from an exhaust gas stream without jeopardizing the integrity of the filter bed.

Figure 1:
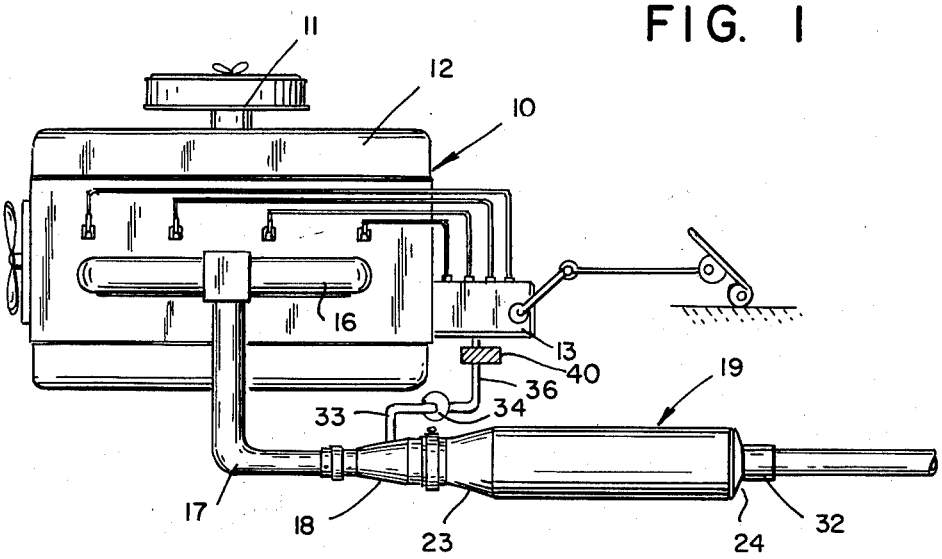
FIG. 1 is an internal combustion engine embodying the present invention.
Figure 2:
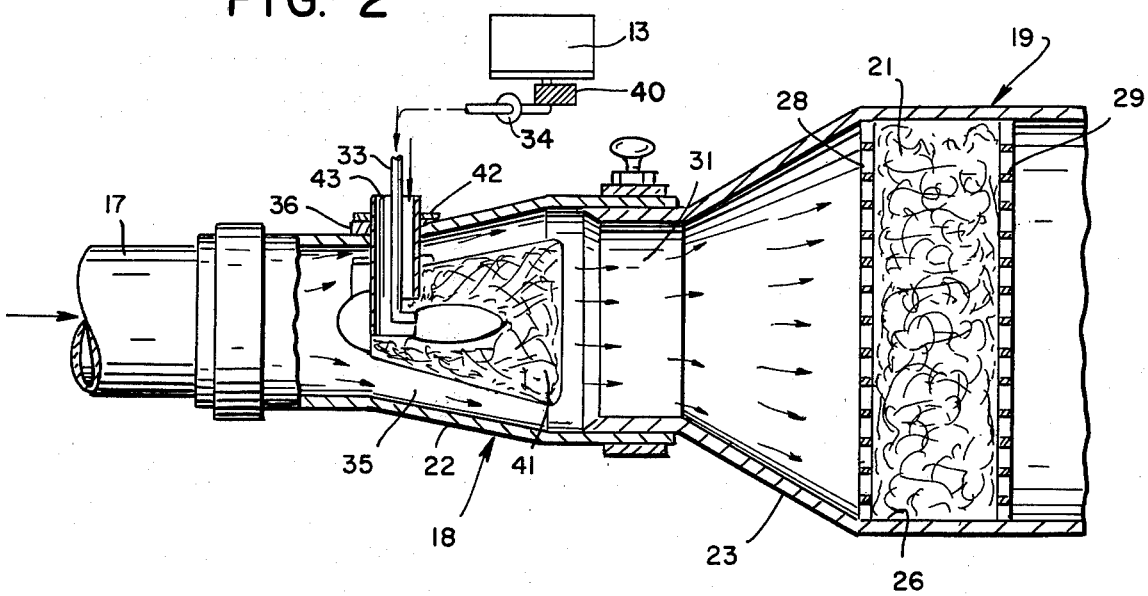
FIG. 2 is a cross-sectional view taken along line 2—2 in FIG. 1.

To facilitate the present description, at the internal combustion engine 10 the exhaust gas created will be considered to be of the diesel type. In this type of engine, air is sequentially introduced to the various combustion chambers from an air filter 11, by way of manifold 12. Fuel is thereafter metered into each combustion chamber from a fuel pump 13 by way of engine control linkage 14.

The engine's hot exhaust gas stream is carried from exhaust manifold 16 and conducted through an exhaust pipe 17 to a gas preheater 18 and to a smoke filter 19. Although a sound absorbing muffler could be connected into the exhaust gas system, such an element is not essential with respect to the instant arrangement.

The exhaust gas stream, subsequent to leaving exhaust manifold 16 will be within a temperature range of about 200° to 1200° F. The precise gas temperature will depend on the operating conditions of the engine. For example, at low and idle speeds the exhaust gas will normally be relatively cool and will carry a considerable amount of particulates. Consequently, as the exhaust gas stream enters filter 19, the particulates will be retained along the many diverse passages within the filter bed 21.

While the hot exhaust gas is comprised primarily of a combination of gases, it normally embodies sufficient oxygen content to support at least a limited degree of combustion within the stream itself.

Filter 19 comprises in essence an elongated metallic casing 22 having opposed end walls 23 and 24 which define an internal reaction chamber 26 therebetween. The latter chamber is occupied by at least one filter bed 21, and in another embodiment, two beds formed of a material particularly adapted to provide a plurality of irregular gas passages.

The function of this bed 21 or beds, is to define a series of passages along which the exhaust gas will pass. During such passage, the particulate matter which still remains in the gas stream will be snagged and retained along the various passage walls.

In one embodiment, filter bed 21 can be formed of a metallic, mesh-like mass such as steel wool or the like, which is shaped to substantially fill reaction chamber 26.

Bed 21 can optionally be laterally supported at its upstream and downstream ends by perforate panels 28 and 29, or other transverse members. The latter are carried, or depend from the casing 22 wall to support the one or more filter beds therein against deformation under the influence of hot gas.

The filter upstream wall or panel 23 is provided with inlet port 31 for introducing gas to the upstream side of the bed. In a similar manner, the downstream wall 24 is communicated with an outlet port 32 to carry away gases which leave the bed.

Preheating segment or unit 18 is positioned upstream of the filter 19 whereby to contact at least a portion of the incoming exhaust gas stream before the latter enters main filter bed 21.

Toward achieving adequate preheating of the exhaust gas stream within preheater 18, an injection system is incorporated into said unit. The latter is in turn communicated with a source of a combustible fuel. Said fuel source can be in either a liquid or gaseous form to achieve the desired preheating function.

The supplementary fuel source can, as presently shown, be diesel fuel utilized for powering engine 10. Alternatively, it can be a compressed gas unit embodying a gas such as propane or the like which is carried for the express purpose of injection into preheater 18. In brief, fuel for preheating at least part of the exhaust gas stream, can be any of a number of known volatile substances, hydrocarbon or otherwise, which are capable of combusting within a catalyst chamber.

The supplementary fuel injection system thus is communicated with fuel pump 13 together with suitable metering means or secondary pump 34, having the inlet side connected to the fuel pump 13. Said metering means 34 is connected to and operably controlled by timing means 40 for periodically actuating it to commence the necessary fuel flow.

As secondary pump 34 is periodically actuated, a measured amount of diesel fuel will be passed into conduit 33 which terminates fuel injector 36. The latter opens within preheater 18 catalyst chamber 35 which is defined in general by the peripheral wall of the preheater casing having a catalyst bed 41 disposed therein.

Said catalyst bed 41 is preferably supported within a suitable guide member or frame 44 having an inlet at the upstream end to admit a limited amount of the exhaust gas prior to the latter being heated. Thus, incoming exhaust gas will enter the catalyst bed 41 which, as in the instance of the main filter, comprises a mass formed of a medium such as shredded steel, steel wool, or the like.

To operate most efficiently, the catalyst bed 41 is provided with a suitable catalyst material to initiate combustion of solid particulates as the diesel or other fuel is introduced thereto, together with the air and/or the incoming exhaust gas.

Supplementary fuel injector 36 is mounted to preheater 18 by a fitting 42 which traverses a wall of said preheater and which embodies an air inlet passage 43. The latter, as shown, can be disposed circumferentially of injector 36, or it can comprise a separate conduit which terminates in the vicinity of the fuel injector 36 discharge opening.

Physically, heating of the exhaust gas stream is achieved by introducing at least a portion of the exhaust gas stream into the catalyst bed 41. The combustible fuel, for example diesel fuel or the like, in a desired amount, is concurrently metered from a fuel source 13 into bed 41 together with an amount of air whereby to form a combustible mixture. Upon contacting catalyst bed 41, the relatively cool fuel/air mixture will be ignited.

The resulting, heated products of combustion from the ignition will intermix with the cooler exhaust gas such that the latter will be elevated to a temperature in excess of that temperature necessary to combust the carbon particles which are carried in the exhaust gas stream.

Preheating of the exhaust gas prior to its entering the filter bed 21 can be achieved at desired intervals of time depending on the operation of engine 10. For example, periodic introduction of the fuel to the catalyst bed 41 can be preset to occur at desired time intervals. Thus, during any phase of engine operation there will be minimal opportunity to reach such a level of collected particulate matter on the main filter bed that the excess is carried off by the exhaust gas stream and/or the filter bed effectiveness is degraded.

It is appreciated, however, that as above noted there can be an accumulation of particulate matter within filter bed 21 under certain conditions. Therefore, said matter is not combusted, or it is in such large quantities that it cannot be readily combusted by the preheating treatment of the exhaust gas.

The present embodiment of the invention illustrates a single main filter bed 21 within filter 19. However, it is appreciated that the filter can comprise a plurality of discrete filter beds which are sequentially spaced and individually supported to withstand the hot exhaust gas stream.

Other modifications and variations of the invention as hereinbefore set forth can be made without departing from the spirit and scope thereof, and therefore, only such limitations should be imposed as are indicated in the appended claims.

We claim:

1. Method for treating an exhaust gas stream which carries an amount of particulate combustible matter, which method includes the steps of;

separating a minor flow of exhaust gas from the exhaust gas stream, introducing the minor exhaust gas flow into contact with a catalytic material, and concurrently introducing a combustible medium with the minor exhaust gas flow into contact with said catalytic material to initiate combustion thereof, intermixing said heated minor flow of exhaust gas with the exhaust gas stream, to provide the mixed stream with a temperature exceeding the ignition temperature of the combustible particulate matter, and passing the mixed, heated gas stream into a main filter element in which the residual particulate matter is retained whereby to incinerate said particulate matter.

2. In a system for treating the exhaust gas stream discharging from an internal combustion engine to remove particulate matter from said stream, and including a filter segment having at least one filter bed positioned to contact said exhaust stream, an exhaust gas preheating means disposed upstream of said filter segment and including a casing defining an exhaust gas preheating chamber having an inlet port communicated with said internal combustion engine to receive the entire exhaust gas stream passing therefrom, a catalyst bed within said exhaust gas preheating chamber and positioned to divide the exhaust gas stream into first and second stream segments, means to direct said first exhaust gas stream segment into said catalyst bed, fuel injection means communicated with a source of a combustible fluid, and having a discharge port opening into said catalyst bed, and means to periodically inject an amount of said fuel into said catalyst bed whereby to initiate combustion in the latter, such that the products of said combustion will intermix with and raise the temperature of said first exhaust gas stream segment prior to the first and second exhaust gas stream segments being recombined upstream of the filtering bed.

3. In the apparatus as defined in claim 1, wherein said at least one filter bed includes; two or more filter beds.

4. In the apparatus as defined in claim 1, including; conduit means communicating said catalyst bed with a source of a combustion supporting gas, and a fuel pumping means in said conduit means, being operably connected to said control means.

5. In the apparatus as defined in claim 3, wherein; said combustion supporting gas is air.

6. In the apparatus as defined in claim 1, wherein; said combustible fluid is a combustible gas.

7. In the apparatus as defined in claim 1, wherein; said combustible fluid is a liquid fuel.

8. In the apparatus as defined in claim 1, wherein; said combustible fluid is concurrently furnished to said internal combustion engine for operating the latter.

* * * * *